US010789885B1

(12) United States Patent
Hrehor, Jr. et al.

(10) Patent No.: US 10,789,885 B1
(45) Date of Patent: Sep. 29, 2020

(54) INFORMATION HANDLING SYSTEM INCLUDING A DUAL SCREEN TRANSPARENT OLED FOR A DISPLAY WITH POWER SAVINGS

(71) Applicant: Dell Products L.P., Round Rock, TX (US)

(72) Inventors: Robert D. Hrehor, Jr., Round Rock, TX (US); Brandon J. Brocklesby, Pflugerville, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/388,105

(22) Filed: Apr. 18, 2019

(51) Int. Cl.
*G09G 3/3225* (2016.01)
*G09G 3/20* (2006.01)

(52) U.S. Cl.
CPC ..... *G09G 3/3225* (2013.01); *G09G 3/2003* (2013.01); *G09G 2300/0452* (2013.01); *G09G 2320/062* (2013.01); *G09G 2320/0686* (2013.01); *G09G 2330/021* (2013.01); *G09G 2360/04* (2013.01)

(58) Field of Classification Search
CPC ..... G09G 3/3225; G09G 3/2003; G09G 2300/0452; G09G 2320/062; G09G 2320/0686; G09G 2330/021; G09G 2360/04
See application file for complete search history.

(56) References Cited

U.S. PATENT DOCUMENTS 8,362,992 B2 * 1/2013 Kuhlman ..... G02F 1/13306 345/1.1
9,153,165 B2 * 10/2015 Zhang ..... H05B 33/12
2018/0217429 A1 * 8/2018 Busch ..... G02F 1/1395

* cited by examiner

*Primary Examiner* — Lisa S Landis
(74) *Attorney, Agent, or Firm* — Zagorin Cave LLP

(57) ABSTRACT

An information handling system includes a dual sided display with a transparent OLED and switchable elements on each side of the OLED display switchable to be either opaque and white or clear. In order to save power, an OLED display controller turns off a first plurality of pixels in the transparent OLED display responsive to the information handling system being in a power savings state and the OLED display controller receiving display information indicating the plurality of pixels should emit white. Rather than driving the pixels to emit white, the OLED display controller turns off, thereby causing the pixels to be transparent and allowing the white opaque switchable element to be seen through the pixels.

20 Claims, 5 Drawing Sheets

INFORMATION HANDLING SYSTEM INCLUDING A DUAL SCREEN TRANSPARENT OLED FOR A DISPLAY WITH POWER SAVINGS

BACKGROUND

Field of the Invention

The present invention relates to information handling systems, and more particularly to information handling systems utilizing a dual sided display with a transparent OLED.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

In general, information handling systems include traditional 2 in 1 notebooks allowing customers multiple use cases including, clamshell, tent, and tablet mode. Utilizing a dual sided display provides more flexibility for implementing the various use cases. Improvements in using dual sided displays are desirable to provide greater performance capability for information handling systems.

SUMMARY OF EMBODIMENTS OF THE INVENTION

In at least one embodiment of the invention, an information handling system includes a transparent organic light emitting diode (OLED) display. A first switchable element is disposed on a first side of the transparent OLED display and is operable to transition between being white and opaque in a first state to being clear in a second state. A second switchable element is disposed on a second side of the transparent OLED display and is operable to transition between being opaque in the first state and being clear in the second state. An OLED display controller controls the transparent OLED display and is operable to turn off a first plurality of pixels in the transparent OLED display responsive, at least in part, to the OLED display controller receiving color information indicating the pixels should emit white. Turning off the first plurality of pixels causes them to be transparent and allows the white of the first switchable element to be seen through the first plurality of pixels.

In another embodiment a method of operating an information handling system includes controlling a first switchable element disposed on a first side of a transparent organic light emitting diode (OLED) display to be opaque and white in response to a first control setting for the first switchable element. The first switchable element is clear responsive to a second control setting for the first switchable element. An OLED display controller turns off a first plurality of pixels in the transparent OLED display responsive, at least in part, to the OLED display controller receiving color information indicating the first plurality of pixels should emit white, being turned off causing the first plurality of pixels to be transparent and allowing the white of the first switchable element to be seen through the first plurality of pixels.

In another embodiment, a method of operating an information handling system includes, in a first configuration of the information handling system, controlling a first switchable element disposed on a first side of a transparent organic light emitting diode (OLED) display to be opaque and white. The method further includes controlling a second switchable element on a second side of the transparent OLED display to be clear. A first plurality of pixels in the transparent OLED display are turned off responsive to the information handling system being in a power savings state and an OLED display controller receiving color information indicating the first plurality of pixels should emit white. Being turned off causes the first plurality of pixels to be transparent and allows the white of the first switchable element to be seen through the first plurality of pixels.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
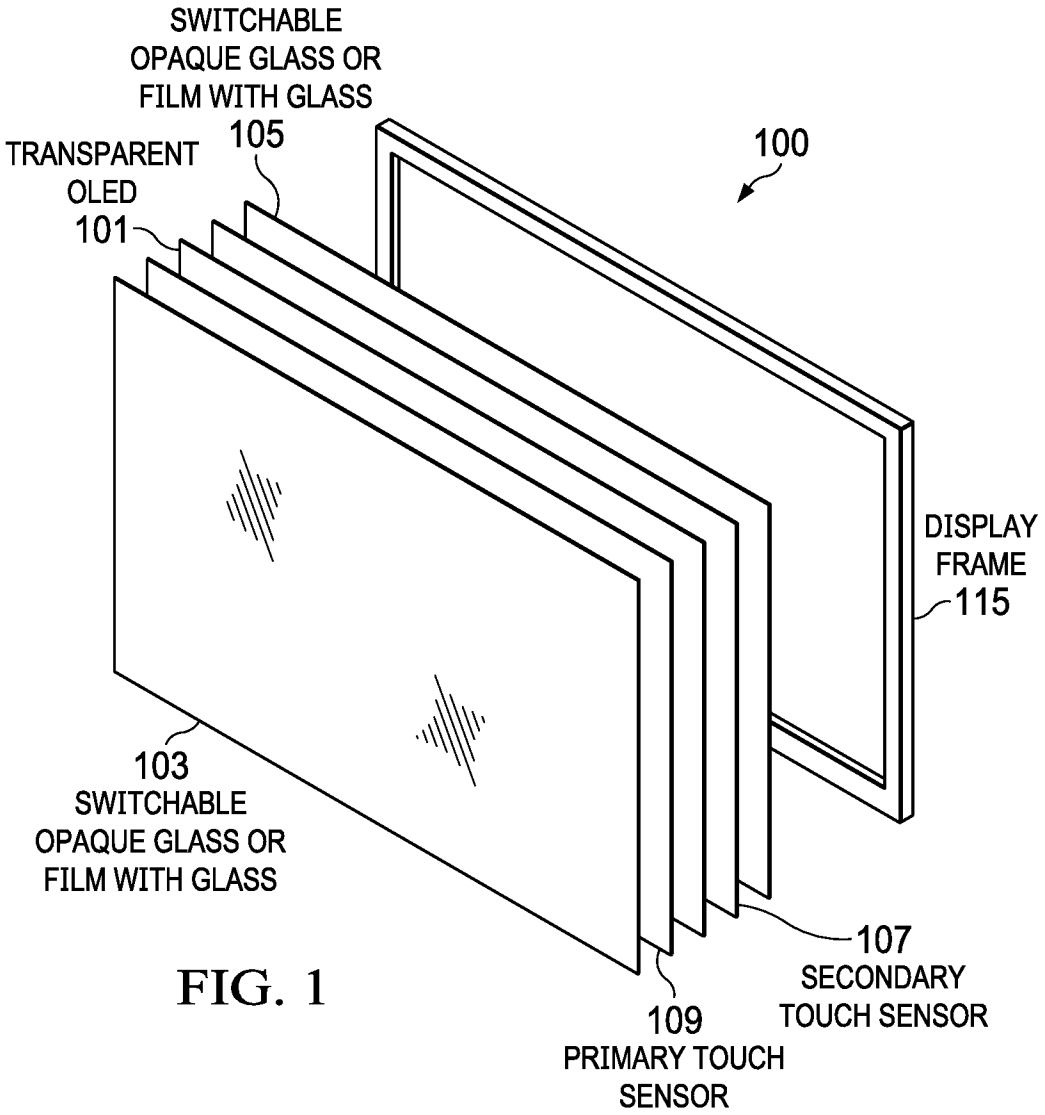
FIG. 1 illustrates an exploded view of a dual sided display according to an embodiment.

Referring to FIG. 1, an embodiment provides a display 100 of an information handling system that utilizes a transparent organic light emitting diode (OLED) display 101 with switchable elements (e.g., glass or film) 103 and 105 on opposite sides of the transparent OLED display 101. Embodiments include touch sensors 107 and 109 on respective sides of the transparent OLED as well. A frame 115 holds the transparent OLED, the switchable elements, and the touch sensors. One advantage of the embodiment of the display shown in FIG. 1 is the thinness of the display 100 even with switchable elements on both sides.

The transparent OLED includes pixels that when energized emit light towards each switchable element according to the color specified for the particular pixel. In an embodiment, each pixel includes a red, green, and blue sub-pixel. In an embodiment, each sub-pixel is controlled by eight bits of color information and thus 24 bits are used to specify the color of each pixel. The color of each pixel is specified according to the intensity of the red, green, and blue sub-pixels, implemented in OLEDS as light emitting diodes. The number of colors that can be generated by the transparent OLED display with eight bits per sub-pixel is over 16 million colors. In a transparent OLED display, when the pixels are not energized, the pixels are transparent.

Figure 2:
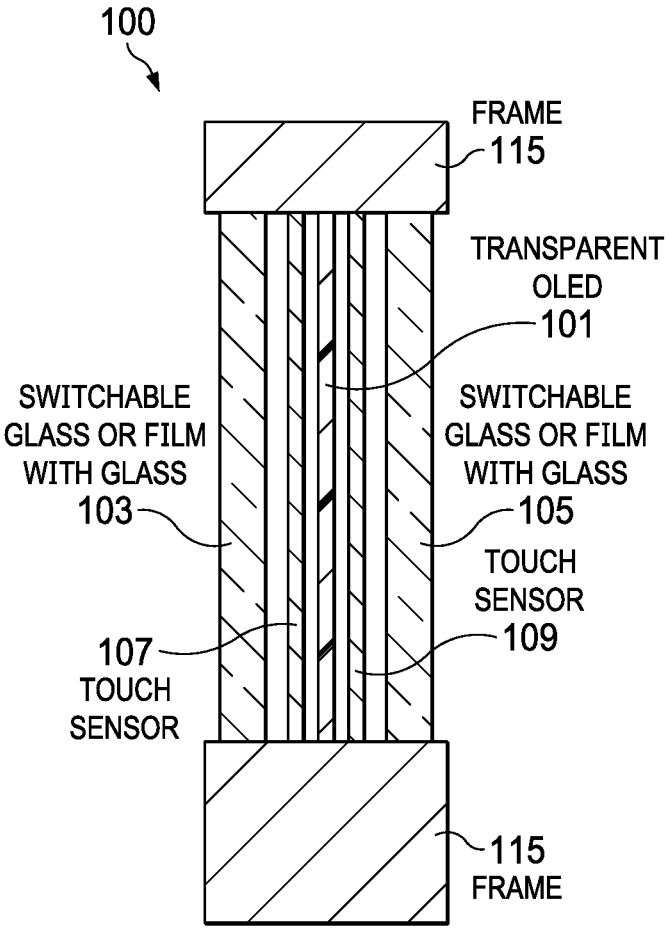
FIG. 2 illustrates a cross section of the dual sided display according to an embodiment.

FIG. 2 illustrates a cross section of an embodiment of the information handling system display 100 showing the frame 115, the switchable elements 103 and 105, the touch sensors 107 and 109 and the transparent OLED display 101. Note that in an embodiment, the touch sensors are integrated into the switchable glass or film.

Figure 3:
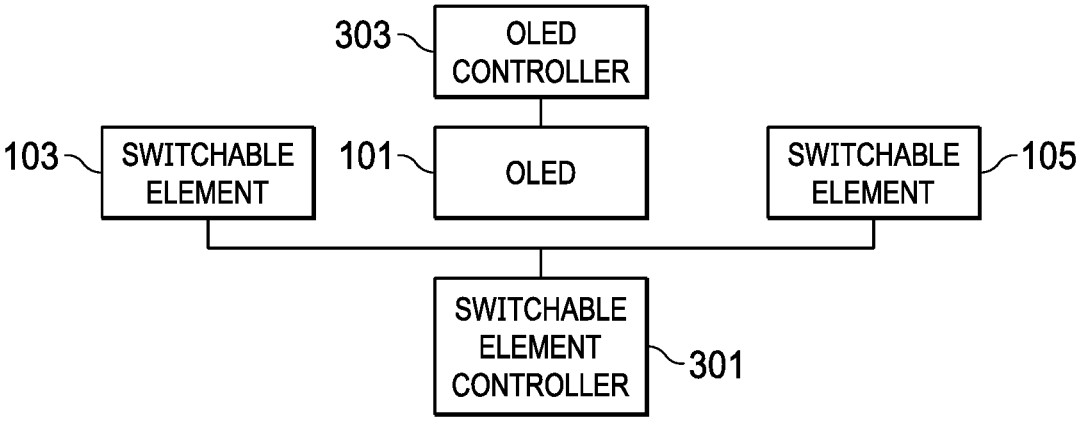
FIG. 3 illustrates a block diagram of a control structure utilized in the dual sided display.

Referring to FIG. 3, controller 301 controls the switchable elements (glass or film) 103 and 105. In an embodiment the switchable elements utilize liquid crystals and the switchable elements transition between transparent and opaque by supplying a voltage or other control signal to apply an electric field (transparent) or remove an electric field (opaque) to thereby drive the liquid crystal molecules into an aligned or disordered array. When powered off, the liquid crystals are randomly oriented causing the switchable element to be opaque. Using an applied electric field to orient the liquid crystal molecules, the switchable element becomes transparent. Thus, the controller 301 causes one or both of the switchable elements of the display to be transparent as explained more fully in describing various use cases. FIG. 3 also illustrates the transparent OLED display controller 303 that operates to control the OLED display 101 by energizing the pixels in the transparent OLED display based on received color information, thereby causing the transparent OLED display to provide an image specified in the color information.

Figure 4:
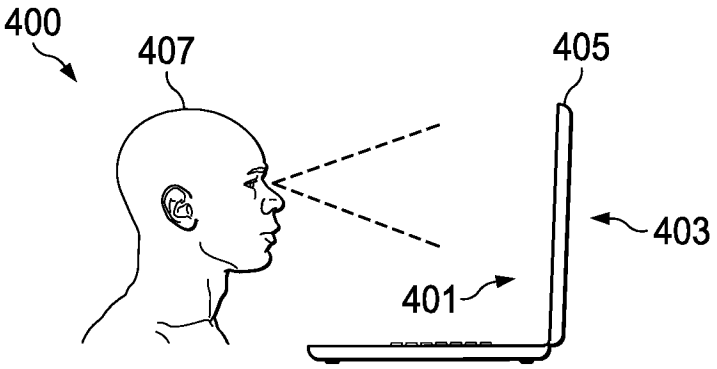
FIG. 4 illustrates a use case in which the information handling system is used in a clamshell configuration.

FIG. 4 illustrates a first use case in which the information handling system 400, e.g., a notebook computer, is in a clamshell configuration. In an embodiment the display 405 of the information handling system includes an OLED display, a switchable element on each side of the OLED display and optionally touch screen sensors integrated as part of the display 405. The switchable element on side 401 (primary side) of the display 405 is energized, or otherwise caused to be clear, while the secondary switchable element on side 403 is not energized, or otherwise caused to be opaque. That allows the user 407 to see through the primary switchable element on side 401 of the display 405.

Figure 5:
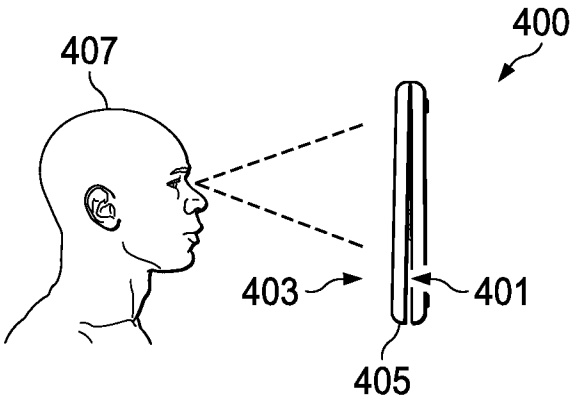
FIG. 5 illustrates a use case in which the information handling system is used in a tablet configuration.

FIG. 5 illustrates a tablet configuration for the information handling system 400. The switchable element on the secondary side 403 is energized to be clear while the primary side 401 is not energized and opaque. In an embodiment, in the tablet configuration (notebook closed) the OLED display controller adjusts the scan of the OLED display to provide a standard image to the user 407. Absent adjusting the scan of the OLED display for user 407, the image would appear flipped. In an embodiment, sensors determine the configuration of the information handling system to determine whether to provide a standard scan or adjusted scan to provide a standard image from the perspective of the user. In an embodiment, the user inputs the configuration for the information handling system through a user interface or otherwise controls how the OLED display should be scanned and thereby control whether the user sees a standard or flipped image.

Figure 6:
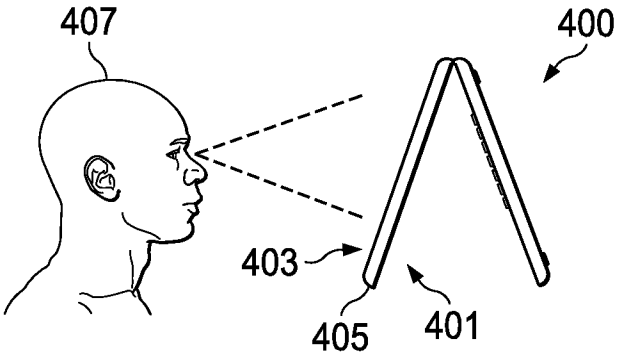
FIG. 6 illustrates a use case in which the information handling system is used in a tent configuration.

FIG. 6 illustrates a tent configuration for the information handling system 400. The secondary side 403 is energized to be clear to allow the user 407 to view the OLED display while the primary side 401 is not energized and opaque. In another embodiment, in the tent configuration the OLED display controller adjusts the scan to provide a standard image to the user 407 (or otherwise the image would be reversed to the user). In an embodiment, sensors determine the configuration of the information handling system to determine the appropriate scan to provide a standard image from the perspective of the user. In an embodiment, the user inputs the configuration for the information handling system through a user interface or otherwise controls how the OLED should be scanned and thereby control whether the user sees a standard or reversed image.

Figure 7A:
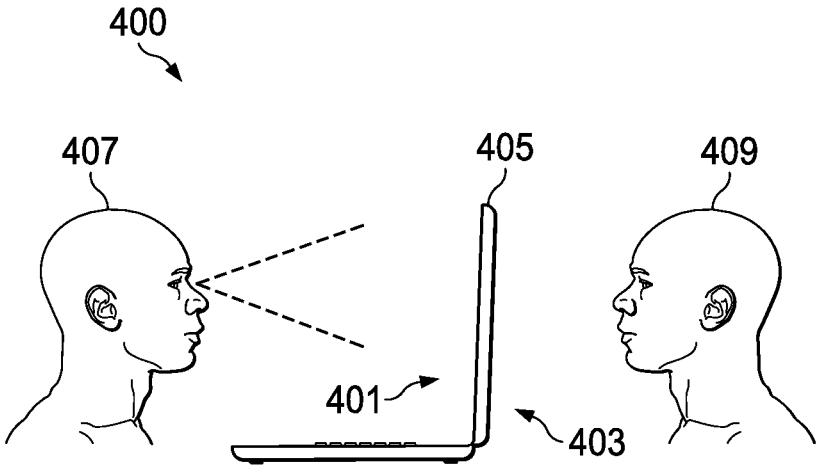
FIG. 7A illustrates a use case in which the information handling system is used in a clamshell configuration with two users and a first user of the two users can view the screen.
Figure 7B:
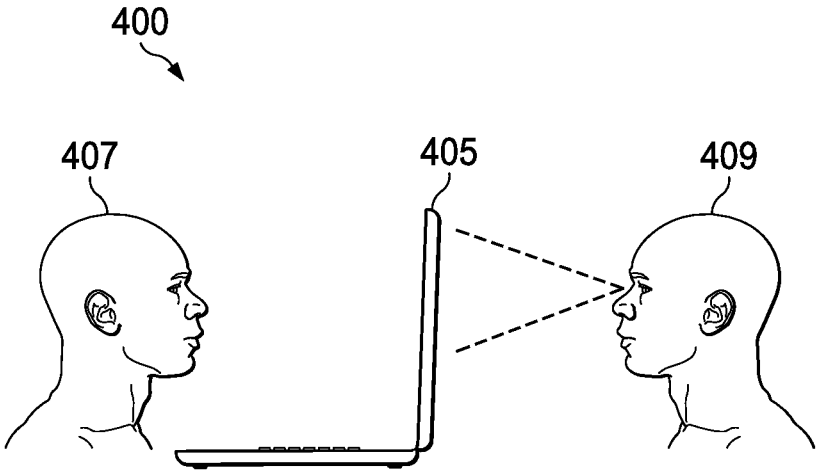
FIG. 7B illustrates a use case in which the information handling system is used in a clamshell configuration with two users and a second user of the two users can view the screen.

FIGS. 7A and 7B illustrates another use case for a clamshell configuration for the information handling system 400. The use case includes two users 407 and 409. During a first time period the primary side switchable element on side 401 is energized to be clear while the secondary side switchable element 403 is not energized and opaque and the user 407 can view the OLED as shown in FIG. 7A. The user 407 can quickly share the image with user 409 by toggling a specified key or series of keys or otherwise using a user interface or voice command to cause the secondary switchable element on side 403 of the display 405 to become clear and the primary switchable element 401 to become opaque. The image is scanned appropriately for user 409 with the switchable element 403 energized. User 407 can reconfigure the switchable elements so both switchable elements are clear, however, for one of the users 407 or 409, the image will be reversed.

Note that the same approach shown in FIGS. 7A and 7B can be applied, e.g., to desktop monitors to allow the transparent OLED to be turned off (therefore transparent)

and the switchable elements on both sides energized so someone sitting at a desk behind a monitor can view a visitor sitting in the office and the visitor can view the person behind the desk. In addition, the monitor(s) can be used as shown in FIGS. 7A and 7B to share screens with someone sitting opposite.

Note that the switchable elements can be of various colors when opaque. Thus, the switchable elements can be used to provide a desired design element to the information handling system. For example, switchable colored glass can be utilized to provide a desired design theme. The glass is clear when energized and the desired color when not energized. In other embodiments, the switchable elements are white when opaque. Using white for the opaque element provides power savings opportunity. In order to generate white, each RGB component of a pixel is driven equally. However, transparent OLEDS have the advantage of being clear when powered off. Thus, an OLED display controller, in order to save power, can power down those pixels when the color information indicates a particular pixel or group of pixels in a frame should be white. As the OLED display controller scans the pixels of each horizontal line in the frame, those pixels identified as white are turned off or not energized (as opposed to the RGB elements being driven at some level) to allow the white opaque switching element to be seen through the transparent pixel or group of pixels. Note that the pixel or pixels may attenuate light passing through the transparent pixels by some percentage making it appear less bright than if the pixel were turned on to generate white. Thus, because the image quality may be degraded, in embodiments, use of the white opaque switchable element to provide white in place of driving pixels to emit white, is limited to situations in which the information handling system is operating in a power savings mode. In embodiments, the display controller is notified by other components in the information handling system when a power savings mode is being implemented, based, e.g., on remaining battery, user input, or some other criteria. Alternatively, or in addition, the system may utilize the white of the opaque switching element instead of actively driving pixels to generate white based on lighting conditions or a combination of lighting conditions and power savings modes of operation. Since some systems use switchable elements that are not white when opaque, the OLED display controller receives information indicating the color of the switchable elements when opaque in order to determine if the power savings mode is available for the display.

Systems are capable of generating many colors in addition to white. In one embodiment, color information in the form of an RGB triplet, specifies white as "FFFFFF" thereby indicating the RGB pixel elements should be driven equally at their highest intensity. Other colors of whites may also be sufficiently close to the white color of the opaque switchable element that in a power savings mode and/or appropriate lighting conditions the display controller turns off pixels in a frame to make such pixels transparent thereby allowing the white of the opaque switchable element to pass through the transparent pixels. For example, the hex code FFFFF0 for the color ivory may be close enough to white that under certain conditions the OLED display controller also turns off the pixels for that "close" color. In embodiments, the display controller stores those colors considered "close" to white, such as ivory, allowing the display controller to identify those colors considered close to white and when to turn off pixels in the power savings mode that are close to white and allow the white of the opaque switching element to be seen.

Figure 8:
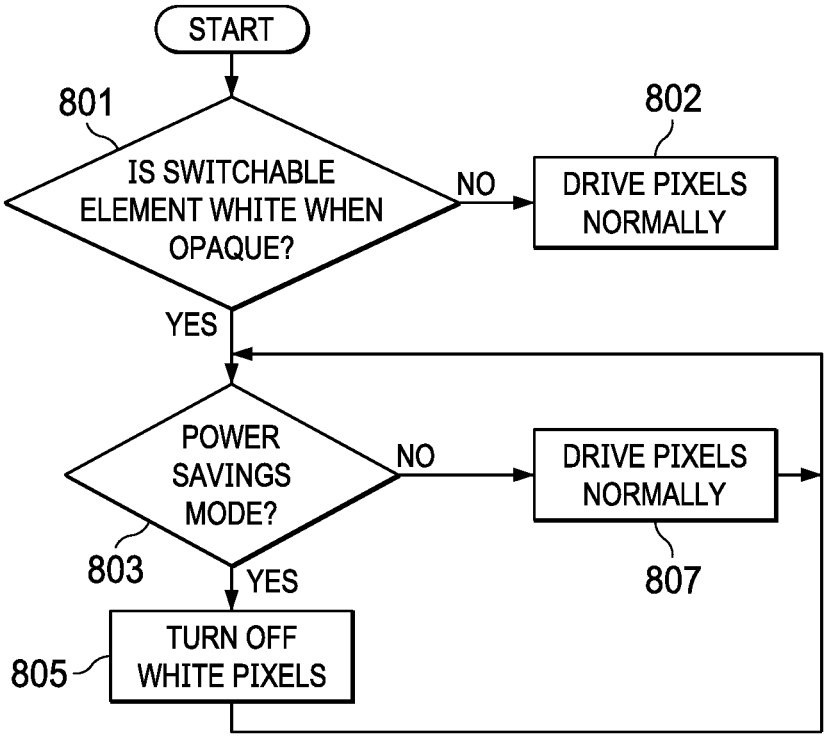
FIG. 8 illustrates a flow chart for the OLED display controller to control pixels to emit white or to turn off the pixels to allow white of the opaque switchable element to be seen through the clear pixels.

FIG. 8 illustrates a flow chart for the display controller to save power by turning off those pixels that are supposed to drive white for a particular video frame. At power on or other appropriate time, in 801 the video controller determines if the opaque switchable element is white. If not, the controller scans goes to 802 and scans each horizontal line based on the received video information. If the video controller determines the opaque switchable element is white in 801, the controller next determines in 803 if the information handling system is in an appropriate power savings mode and/or lighting conditions. If not, the OLED display controller scans each horizontal line using the received color information in 807 and causes the white (and near white) pixels to emit white (or near white) in accordance with the received color information. The controller returns to 803 to check if conditions change.

If the controller determines in 803 that the information handling system is in the appropriate power savings and/or lighting conditions, the controller goes to 805 and causes those pixels that are white (or close to white) to be turned off rather than emit white as the horizontal line is scanned. The controller returns to 803 to determine if the information handling system is still in the appropriate power savings mode and/or lighting conditions and continues to replace emitted white with pixels that are turned off in 805 until conditions in the information handling system change.

Thus, a dual sided notebook display or monitor with power saving features has been disclosed. The description of the invention set forth herein is illustrative and is not intended to limit the scope of the invention as set forth in the following claims. For example, while the invention has been described in an embodiment in which a portable information handling system implements embodiments of the invention, one of skill in the art will appreciate that the teachings herein can be utilized with other information handling systems using stationary monitors. The terms "first," "second," "third," and so forth, as used in the claims, unless otherwise clear by context, is to distinguish between different items in the claims and does not otherwise indicate or imply any order in time, location or quality. Variations and modifications of the embodiments disclosed herein may be made based on the description set forth herein, without departing from the scope of the invention as set forth in the following claims.

What is claimed is:

1. An information handling system comprising:

a transparent organic light emitting diode (OLED) display;

a first switchable element disposed on a first side of the transparent OLED display operable to transition between being white and opaque in a first state to being clear in a second state;

a second switchable element disposed on a second side of the transparent OLED display and operable to transition between being opaque in the first state and being clear in the second state;

an OLED display controller to control the transparent OLED display; and wherein the OLED display controller is operable to turn off a plurality of pixels in the transparent OLED display responsive, at least in part, to the OLED display controller receiving color information indicating the plurality of pixels should emit white, the plurality of pixels being turned off thereby causing the plurality of pixels to be transparent and allowing the white of the first switchable element to be seen through the plurality of pixels.

2. The information handling system as recited in claim 1, wherein the second switchable element is in the second state when the first switchable element is in the first state.

3. The information handling system as recited in claim 1, wherein the second switchable element is white in the first state.

4. The information handling system as recited in claim 1, wherein the OLED display controller is operable to turn off the plurality of pixels in the transparent OLED display further responsive to the information handling system being in a power savings state.

5. The information handling system as recited in 4, wherein the OLED display controller is operable to control the plurality of pixels to emit white when the information handling system is not in the power savings state.

6. The information handling system as recited in claim 1, wherein the OLED display controller is operable to turn off the plurality of pixels in the transparent OLED display responsive to the OLED display controller receiving the color information indicating the pixels should emit a color identified by the OLED display controller as related to white.

7. The information handling system as recited in claim 1, further comprising a second controller to control the first and second switchable elements to be in the first state or the second state.

8. The information handling system as recited in claim 1, further comprising a first touch sensor element disposed on the first side of the transparent OLED display and a second touch sensor element disposed on the second side of the transparent OLED display.

9. The information handling system as recited in claim 1, wherein the first switchable element is glass or film.

10. The information handling system as recited in claim 1, wherein in at least one configuration of the information handling system, the first switchable element is configured to be clear, the second switchable element is configured to be opaque and white, and the OLED display controller is responsive to receiving color information indicating a second plurality of pixels should emit white, to turn off the second plurality of pixels, thereby causing the second plurality of pixels to be transparent and allowing the white of the second switchable element to be seen through the second plurality of pixels.

11. A method of operating an information handling system, comprising:

controlling a first switchable element disposed on a first side of a transparent organic light emitting diode (OLED) display to be opaque and white in responsive to a first control setting for the first switchable element;

controlling the first switchable element to be clear in response to a second control setting for the first switchable element; and an OLED display controller turning off a first plurality of pixels in the transparent OLED display responsive, at least in part, to the OLED display controller receiving color information indicating the first plurality of pixels should emit white, thereby causing the first plurality of pixels to be transparent and allowing the white of the first switchable element to be seen through the first plurality of pixels.

12. The method as recited in claim 11, further comprising:

controlling a second switchable element disposed on a second side of OLED display to be opaque and white in response to a first control setting for the second switchable element;

controlling the second switchable element to be clear in response to a second control setting for the second switchable element; and controlling the second switchable element to be opaque when the first switchable element is clear.

13. The method as recited in claim 12, further comprising, configuring the first switchable element to be clear; and configuring the second switchable element to be opaque and white;

the OLED display controller, responsive to receiving color information indicating a second plurality of pixels should emit white, turning off the second plurality of pixels, thereby causing the second plurality of pixels to be transparent and allowing the white of the second switchable element to be seen through the second plurality of pixels.

14. The method as recited in claim 11, further comprising the OLED display controller turning off the first plurality of pixels in the transparent OLED display further responsive to the information handling system being in a power savings state when the OLED display controller receives the color information indicating the pixels should emit white.

15. The method as recited in claim 14, further comprising:

the OLED display controller controlling the first plurality of pixels to emit white when the information handling system is not in the power savings state.

16. The method as recited in claim 11, further comprising:

the OLED display controller turning off a second plurality of pixels in the transparent OLED display responsive to the OLED display controller receiving display information to cause the second plurality of pixels to emit one or more colors identified by the OLED display controller as related to white.

17. The method as recited in claim 16, further comprising:

the OLED display controller storing information identifying the one or more colors as related to white.

18. A method of operating an information handling system, comprising:

in a first configuration of the information handling system, controlling a first switchable element disposed on a first side of a transparent organic light emitting diode (OLED) display to be opaque and white;

controlling a second switchable element on a second side of the transparent OLED display to be clear; and turning off a first plurality of pixels in the transparent OLED display responsive to the information handling system being in a power savings state and an OLED display controller receiving color information indicating the first plurality of pixels should emit white, the first plurality of pixels being turned off thereby causing the first plurality of pixels to be transparent and allowing the white of the first switchable element to be seen through the first plurality of pixels.

19. The method as recited in claim 18, comprising:

in a second configuration of the information handling system, controlling the first switchable element to be clear;

controlling the second switchable element to be opaque and white; and turning off a second plurality of pixels in the transparent OLED display responsive to the information handling system being in the power savings state and the OLED display controller receiving additional color information indicating the second plurality of pixels should emit white, thereby causing the second plurality of pixels to be transparent and allowing the white of the second switchable element to be seen through the second plurality of pixels.

20. The method as recited in claim 18, further comprising: the OLED display controller controlling a third plurality of pixels to emit white responsive to the information handling system not being in the power savings state and the OLED display controller receiving additional color information indicating the third plurality of pixels should emit white.

* * * * *